US006060673A

United States Patent [19]

Jackman

[11] Patent Number: 6,060,673

[45] Date of Patent: May 9, 2000

[54] INERTIA SWITCH AND MOUNTING THEREFOR

[75] Inventor: Peter Jackman, Farnham, United Kingdom

[73] Assignee: First Inertia Switch Limited, United Kingdom

[21] Appl. No.: 09/011,578

[22] PCT Filed: Aug. 12, 1996

[86] PCT No.: PCT/GB96/01952

§ 371 Date: May 26, 1998

§ 102(e) Date: May 26, 1998

[87] PCT Pub. No.: WO97/07521

PCT Pub. Date: Feb. 27, 1997

[30] Foreign Application Priority Data

Aug. 11, 1995 [GB] United Kingdom ..... 9516482

[51] Int. Cl.[7] ..... H01H 35/14

[52] U.S. Cl. ..... 200/61.45 R; 200/61.45 M

[58] Field of Search ..... 200/61.45 M, 200/61.45 R, 61.52, 345, 302.2, 61.5

[56] References Cited

U.S. PATENT DOCUMENTS

| | | | |
|---|---|---|---|
| 2,671,832 | 3/1954 | Hansard et al. | 200/61.5 X |
| 4,287,398 | 9/1981 | Ziv et al. | 200/61.45 R |
| 4,326,111 | 4/1982 | Jackman | 200/61.45 R |
| 4,463,237 | 7/1984 | Kim | 200/345 |
| 4,533,801 | 8/1985 | Jackman et al. | 200/61.45 R |
| 5,426,273 | 6/1995 | Shiau | 200/302.2 X |
| 5,456,541 | 10/1995 | Ching-Shui | 200/345 X |
| 5,753,872 | 5/1998 | Komiya et al. | 200/61.45 R |

*Primary Examiner*—Renee S. Luebke
*Attorney, Agent, or Firm*—Larson & Taylor

[57] ABSTRACT

Various improvements are disclosed for an inertia switch device. The device includes an inertia body, a casting forming a compartment for the inertia body and providing a rest position therefor, and a toggle operable by the inertia body when it is disturbed from its rest position from a first to a second toggle position. A member mounted in the casing is operable for moving the toggle from its second to its first position. The member may be biased to a rest position in the casing which is independent of the toggle position. There may be three contacts the first of which is electrically connected only to the second when the toggle is in its first position and only to the third when the toggle is in its second position.

14 Claims, 6 Drawing Sheets

INERTIA SWITCH AND MOUNTING THEREFOR

FIELD OF THE INVENTION

This invention relates to inertia switches in which an inertia body is caused by an acceleration over a threshold to move, thus causing a toggle switch to change its state.

BACKGROUND OF THE INVENTION

Examples of such toggle switches include those described in British Patent Specification 2160017 and WO 83/02196. These specifications disclose an inertia switch device comprising an inertia body, a casing forming a compartment for the inertia body and providing a rest position therefor, and a toggle operable by the inertia body when it is disturbed from its rest position from a first to a second toggle position, and a member mounted in the casing operable for moving the toggle from its second to its first position; and WO 83/02196. These specifications disclose an inertia switch device comprising an inertia body, a casing forming a compartment for the inertia body and providing a rest position therefor, and a toggle operable by the inertia body when it is disturbed from its rest position from a first to a second toggle position, and a member mounted in the casing operable for moving the toggle from its second to its first position.

Various aspects of the invention are set forth in the following detailed description.

BRIEF DESCRIPTION OF THE DRAWINGS

Examples of the invention will now be described with reference to the accompanying drawings in which.

DETAILED DESCRIPTION OF THE PREFERRED EMBODIMENTS

Figure 1:
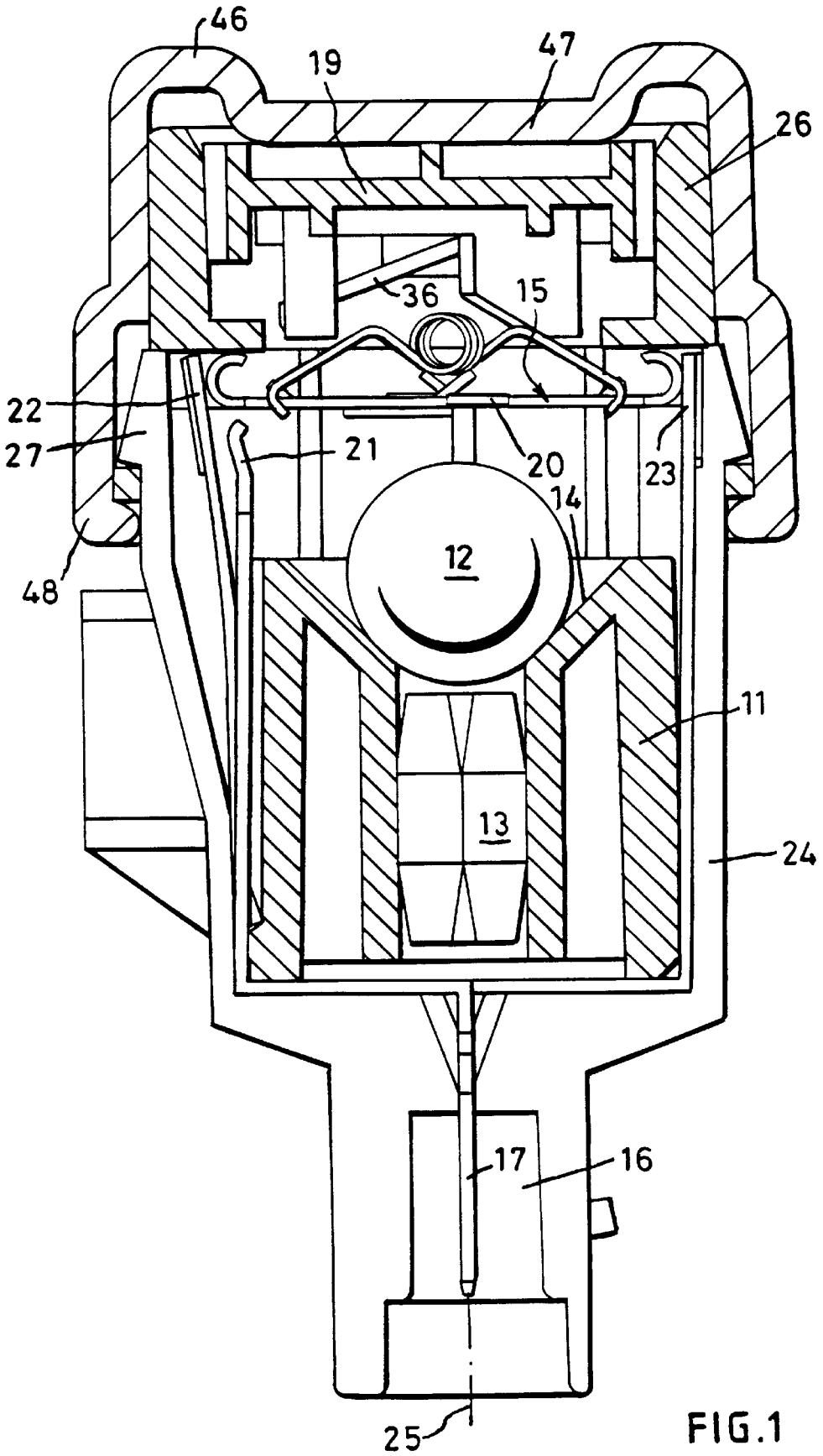
FIGS. 1 and 2 show a vertical central section through an inertia switch in its two states.

FIG. 1 shows an inertia switch containing improvements according to the invention. The basic components of the switch include a lower support 11 defining the bottom of a chamber and providing a frusto-conical seat 14 for an inertia body in the form of a sphere 12 of magnetisable material. The seat contains an optional magnet 13 which is provided to bias the inertia body to its rest position and to hold it in that position while any accelerations to which the switch is subjected remain below a given threshold.

Figure 2:
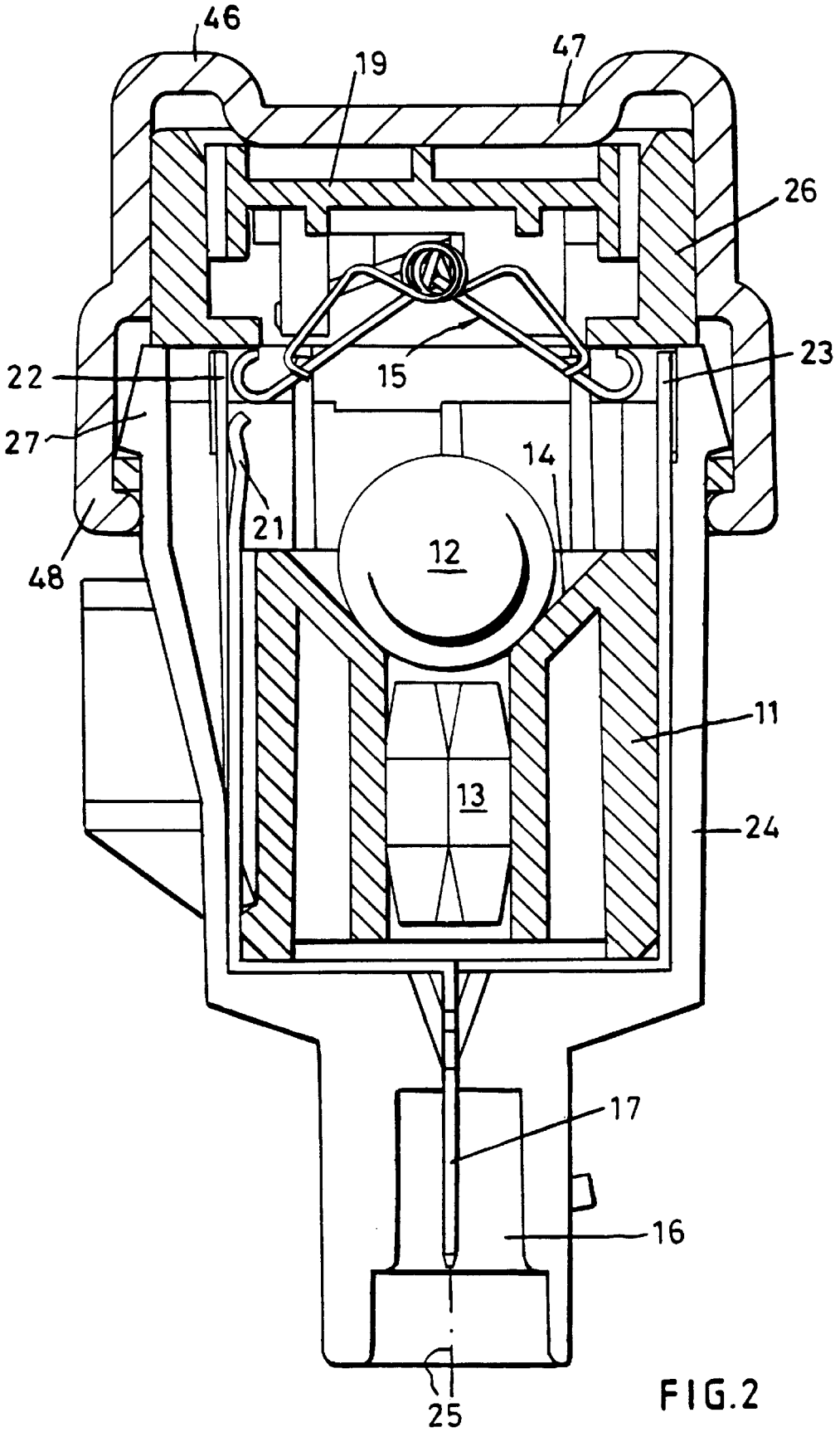

The top of the chamber is defined by a toggle linkage 15 which is movable between a first position in which the toggle is extended as shown in FIG. 1 and a second position in which the toggle is contracted, as shown in FIG. 2.

When the inertia switch is primed, the toggle is in its extended position as shown in FIG. 1 and an electrical switch operable by the toggle is in a first state. When the switch is subjected to an acceleration above the given threshold, the ball moves against the bias of gravity and, if present, the magnet below it, from its rest position to the top of the chamber and strikes the toggle, causing it to move from its extended position to its retracted position as shown in FIG. 2 and this causes the electrical switch to change to a second state. The switch therefore reacts to the application of an acceleration above the given threshold to change the state of the switch and this switch can be used to operate an electrical circuit to respond to the experienced acceleration.

The switch includes a fixed contact 21 and a movable contact 22 on one side of the chamber, the movable contact being movable into and out of contact with the fixed contact when the toggle moves between its positions. This arrangement provides a switch which is made when the acceleration over the given threshold is experienced, since the upwards movement of the inertia body causes the toggle to move from its extended to its contracted position and allows the movable contact 22 to return under its own resilience into contact with the fixed contact 21.

This arrangement can be further improved by providing a fixed contact 23 on the side of the chamber remote from the first side, the toggle in its extended position providing an electrical path between the further fixed contact 23 and the movable contact, but breaking that path when the toggle moves to its contracted position since it is withdrawn from engagement with the contacts 22 and 23. With this arrangement, the movable contact 22 provides a common electrode which is connected in the extended position of the toggle to the further fixed contact 23 through the toggle arms themselves and which springs back in the contracted position of the toggle to engage the first fixed contact 21. This arrangement provides one switch which is made and a second switch which is broken when the switch is subjected to the acceleration over the given threshold, the two switches having a common electrode in the movable contact. The toggle arms remain in contact with the contacts 22 and 23 until after the contact 22 has contacted the contact 21 as the toggle arms move from the FIG. 1 position to the FIG. 2 position so that the switch is a make-before-break switch.

Conventional casings for an inertia switch of the general type so far described are usually moulded in two parts, divided on a central longitudinal plane. Components are assembled transversely to this plane in one half of the casing and the other half of the casing is then fitted over the top. This is a very complicated procedure which does not lend itself to automatic production. In this apparatus, the casing has a main portion 24 moulded in one piece as a cup with an open top, thus allowing all the components to be assembled from the top, one upon the other. There is an opening 16 at the bottom of the casing for electrical connections 17 to the contacts 21–23, which connections pass through the body of the piece 24. The other casing components are open cylinders. The only joints between components of the casing are transverse to the longitudinal axis 25. Each component of the casing encircles the longitudinal axis. This arrangement lends itself much better to automatic assembly since the cup-shaped casing provides a ready receptacle for successive components being assembled.

For the switch to be re-usable, means has to be provided for resetting the toggle 15 from its contracted position to its extended position, and this is usually done by a button at the top of the switch casing. When the button is depressed, the center of the toggle is pressed downwards to cause it to move to, and remain in under the influence of its spring, the extended position. In the conventional switch, the button rests on the toggle and so the level of the button gives an indication of whether the switch is primed or not, the switch being primed when the button is at a low position, and fired when it is in a high position. In the conventional switch, the button has a claw which engages the underside of the toggle arms to prevent the button being ejected when the toggle moves to its contracted position. In the embodiment of the invention, the resetting member comprises a circular button 19 mounted in a hollow cap 26 which forms the second piece of the casing. The second piece also extends in one piece around the longitudinal axis 25 of the casing.

The casing body 24 has tapered shoulders 27 over which the cap 26 is a snap fit: additional fixing is achieved by lugs 28 (FIG. 7) on the casing body which pass through apertures 29 in the cap and are then fused to the cap to provide a permanent fixture.

Within the circular aperture of the cap, there is (FIG. 4) a diametrically opposite pair of vertical guides 31 extending inwards which engage corresponding vertical grooves 32 in the button 19 to prevent rotation of the button within the cap aperture. At a different pair of diametrically opposite locations, the annular wall of the cap is formed with a vertical slot 33, closed at its upper end in which outwardly extending lugs 34 on the button move. The button has a central diametral member 35 extending between the grooves and resilient arms 36 extending downwardly from the annular wall of the button, one on either side of the diametral member, which arms engage horizontal surfaces 37 on the base of the cap to bias the button upwards until it reaches the upper rest position in which the lugs 34 engage the upper ends of the slots 33 in the annular wall of the cap.

The diametral member has four depending members, two on either side. Two members 38 are narrow vertical posts with horizontal lower surfaces whereas the other two members 39 are broader vertical posts, the inner ends 41 of the lower surfaces of which are inclined to the horizontal at the same angle which is assumed by the arms of the toggle in its second, contracted, position. A narrow vertical post 38 on one side of the diametral member lies opposite a broader vertical post 39 on the other side of the member and the two posts 38 are on opposite sides of the diametral member. The outer edges of the vertical posts engage the sides and back of a guide 42 (FIG. 3) formed in a horizontal platform on the casing cap, to prevent excessive lateral movement of the button in two orthogonal directions. At the ends of the diameter orthogonal to the diametral member, further vertical posts 43 extend from the circumference of the button. These further posts engage the outer portions 20 (see FIG. 1) of the toggle arms whereas the inclined lower surfaces of the broad posts below the diametral member engage the central portions of the toggle arms so that when the button is depressed, the toggle arms are pressed downwards and move over their dead center positions to reach the extended position of the toggle. When the button is released, the resilience of the resilient arms 36 lifts the button back to its upper rest position. When the switch "fires", the posts 43 and the inclined lower surfaces form stops to the return movement of the toggle arms and the surfaces 39 can exert an even pressure over a length of the arms when the button 19 is depressed.

In conventional inertia switches, the button for resetting the toggle has been a simple rod, but in the present device the button extends across substantially the whole cross-section of the casing, with a diameter comparable with the extent of the toggle at least in its retracted position. In order to save weight, it has previously been proposed to form apertures in the button, but in the present device the button is formed without apertures so as to avoid ingress of dirt and moisture into the interior of the mechanism.

Figure 6:
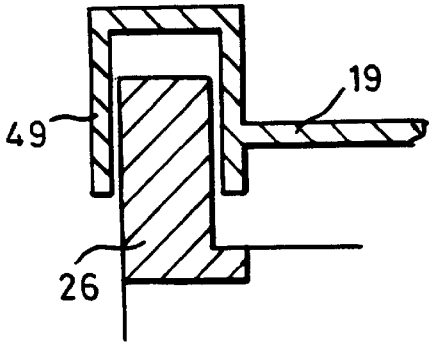
FIG. 6 is a diagrammatic diametral section through another alternative cap.

Any apertures in the button, and the passage in the switch casing along which the button moves are means for ingress of dirt and moisture into the switch, both of which are undesirable. To overcome this problem a cap 46 is provided with a flexible top panel 47 over the button and a skirt 48 to grip the sides of the cap 26 which seals any apertures and passageways in the top of the switch against ingress of dirt and moisture. An alternative arrangement is to extend the button itself over the top of the casing and possibly down its exterior to form a lip 49, as shown in FIG. 6.

Figure 3:
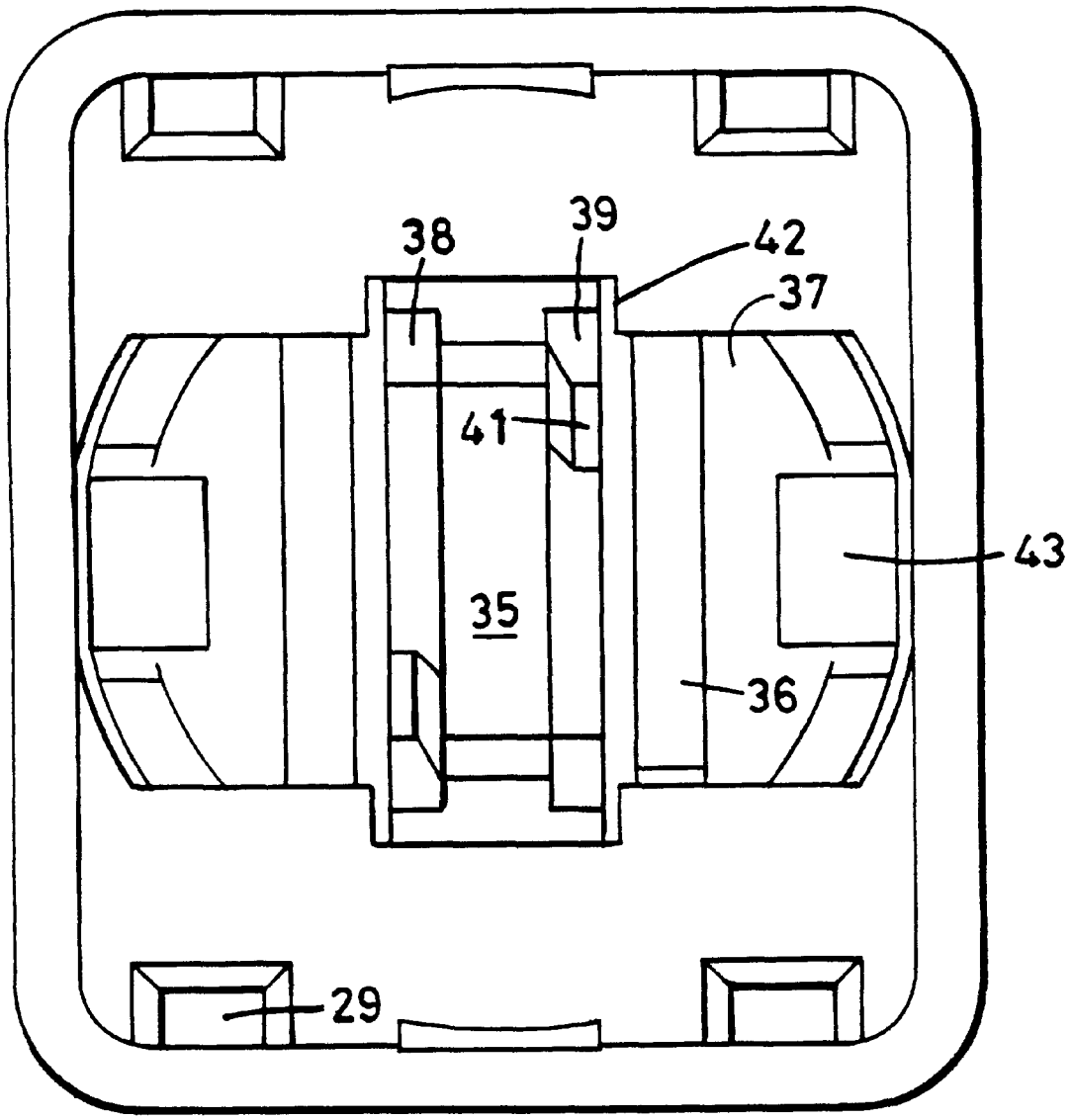
FIG. 3 is an underplan of one form of cap for the casing used in FIGS. 1 and 2.
Figure 4:
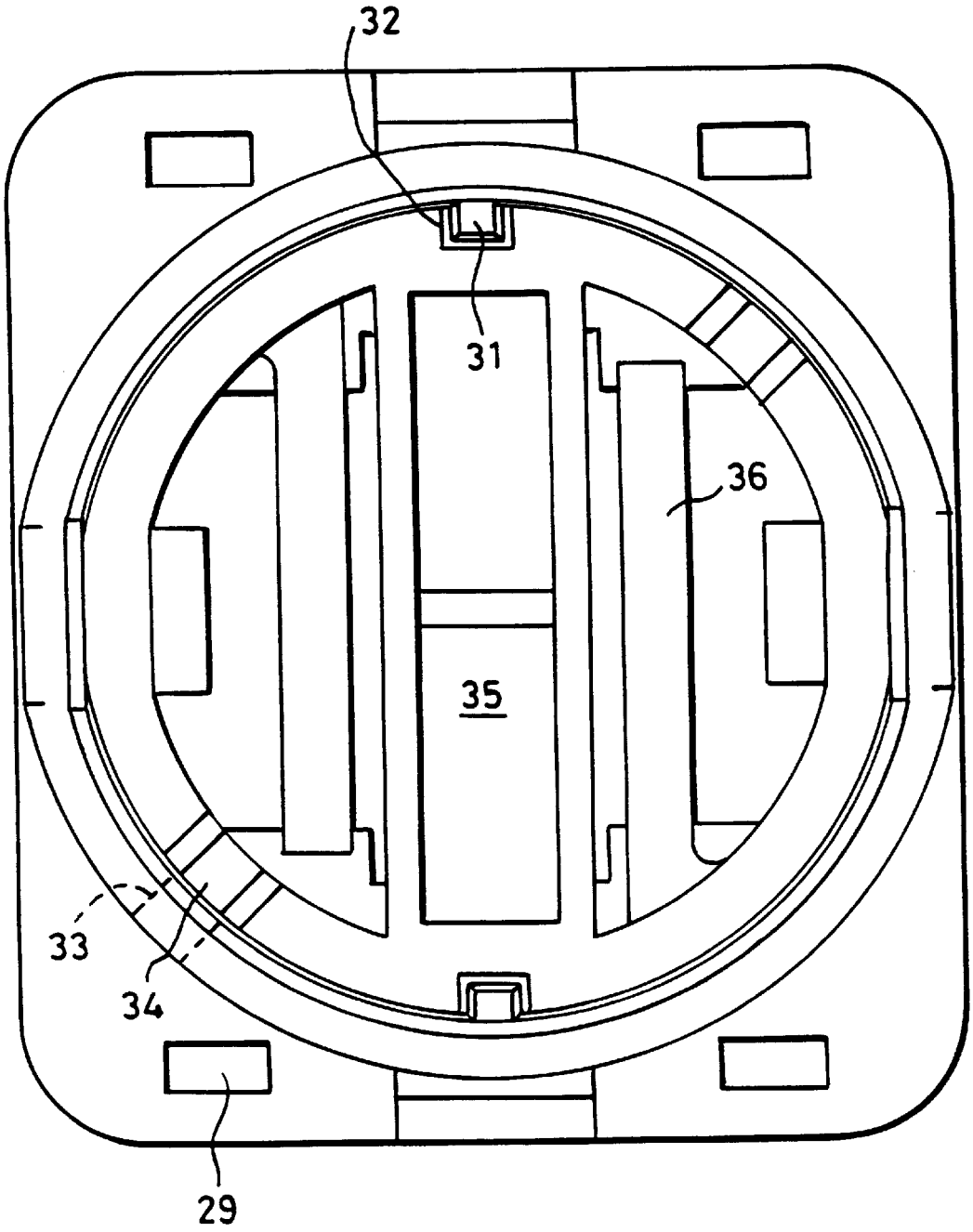
FIG. 4 is a plan view of the same cap.
Figure 5:
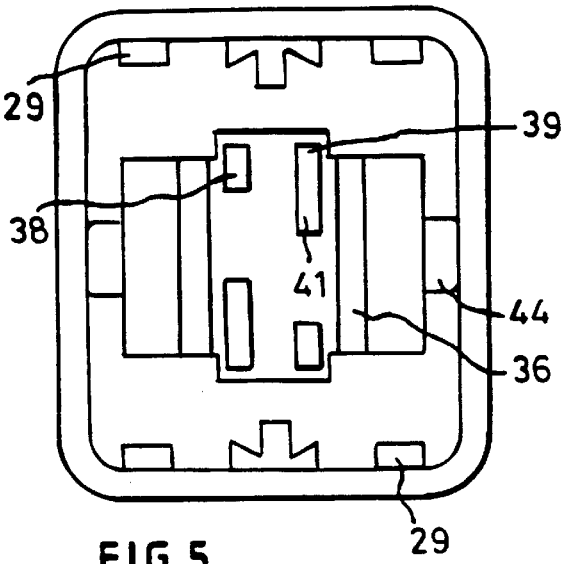
FIG. 5 is an underplan view of an alternative cap.

FIG. 5 shows an alternative cap to that illustrated in FIG. 3 and there is a corresponding difference in the construction of the button. There is no pair of inwardly directed guides 31 and no corresponding grooves 32 in the button. Instead, the lugs 34 of the button of FIGS. 3 and 4 are relocated at ends of the diametral member 35 and the cap has corresponding slots to receive the lugs. There are no vertical posts 43 on the button, but instead at the position occupied by these posts in FIG. 3 the cap has raised shelves 44 which form abutment members for the sides of the top of the button which is a complete unapertured disc. The shelves 44 on the cap form stops for the lugs 20 of the toggle switch as it reaches its contracted state.

Figure 7:
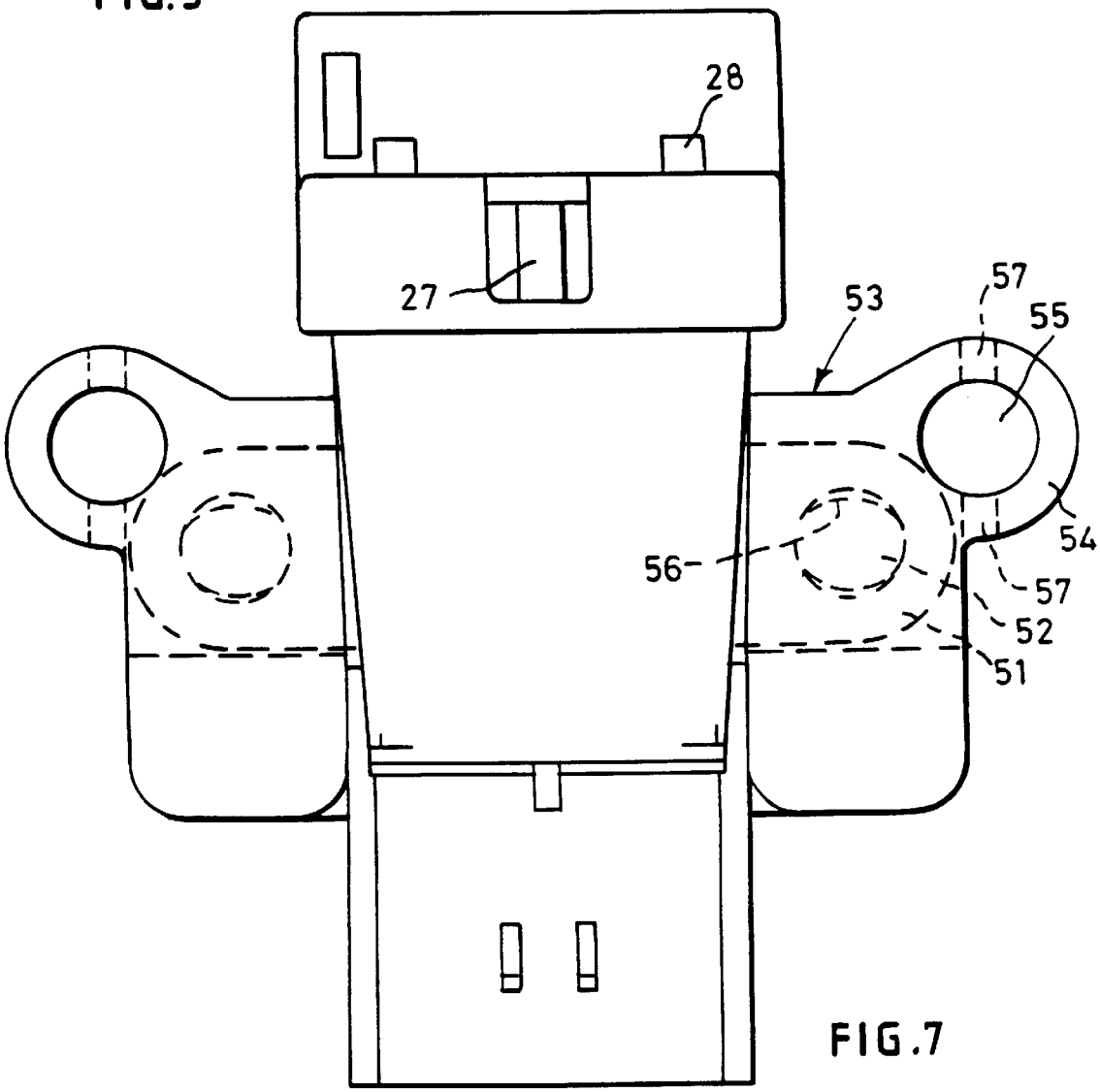
FIG. 7 is a side elevation of the inertia switch of FIGS. 1 and 2 mounted in a fixing adaptor.
Figure 8:
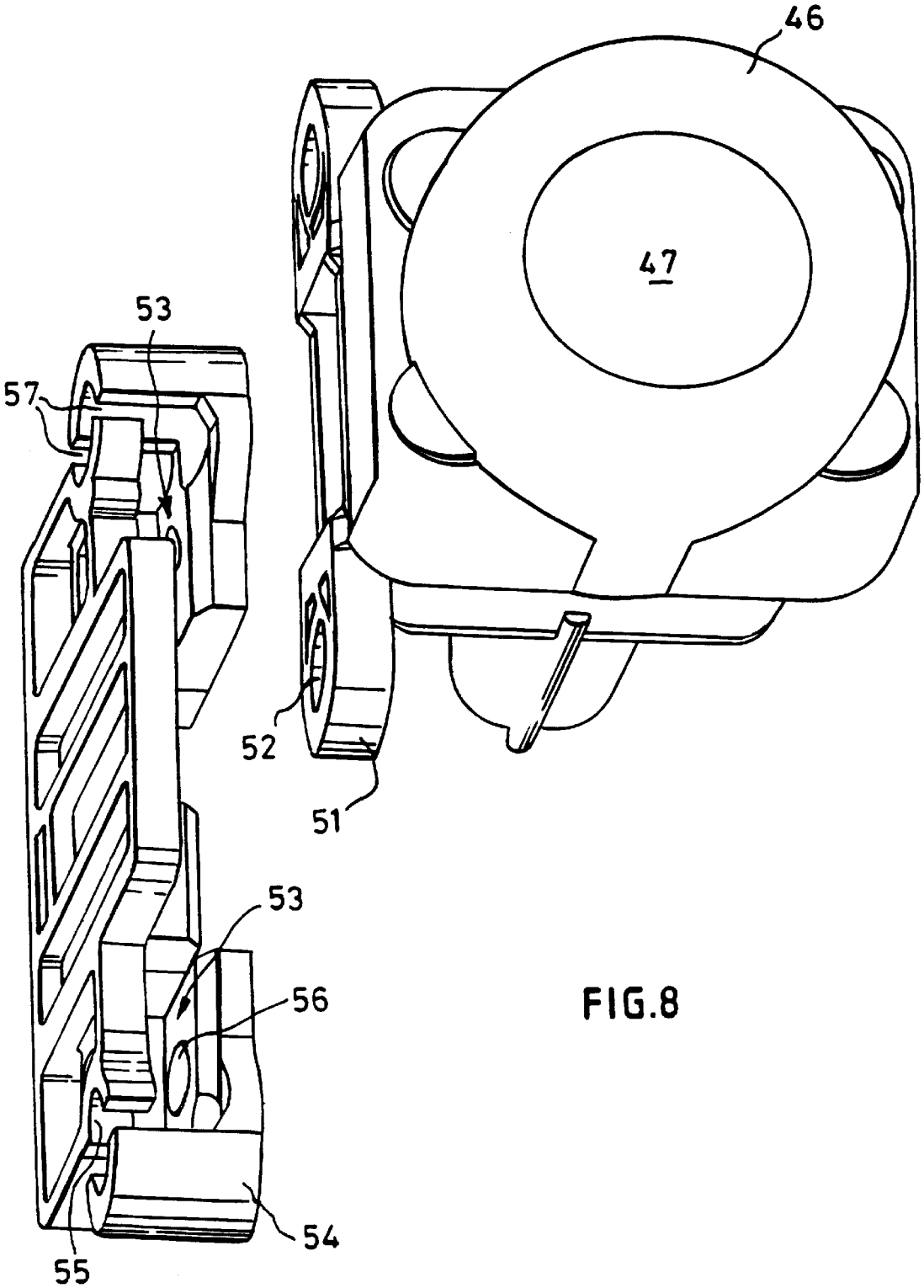
FIG. 8 is a perspective view of the switch separated from the adaptor of FIG. 7.

The casing is intended to be mounted with its axis vertical on a suitable structure and is provided on one side with a pair of laterally extending fixing lugs 51, each lug having a hole 52 for receiving fixing bolts. These apertured lugs can be used directly for fixing the device on a structure, but when the structure has its own fixing holes of a different size and/or different spacing from the holes on the lugs, or bigger fixing screws are specified (for example for use on a car assembly line), an adaptor has to be used, as shown in FIGS. 7 and 8. This adaptor has a broad slot 53 open at the top for receiving the fixing lugs 51 of the casing. The upper walls of the vertical slot are themselves formed with fixing lugs 54 each formed with an aperture 55 of a suitable size and at a suitable spacing required by the structure to which the device is to be fixed. When a fixing member is passed through the apertures 55 in the adaptor fixing lugs, the lateral spacing of the fixing member shafts is less than the maximum lateral distance subtended by the fixing lugs 51 of the casing and the fixing members in the adaptor apertures are located above the fixing lugs 51 of the casing in its position at the base of the slot, thus preventing the casing fixing lugs being removed from the adaptor. It will be seen from FIG. 7 that the upper periphery of the ring defining hole 52 is tangential to the lower portion of the hole 55. A fixing member shaft filling the hole 55 will thus retain the lug 51 in the base of the slot 53. A secure fixing arrangement is thus provided.

On the front wall of the slot, the aperture 55 for the fixing member is defined by a continuous ring, but at the rear side of the slot, the ring is cut at 57 on a vertical axis both above and below the aperture to allow the adaptor to flex during tightening of fixing members in the aperture so as to grip the lugs of the casing more securely.

As shown in FIG. 8 the front wall of the slot has a tapering shoulder 56 which engages the hole 52 to latch the casing in position.

I claim:

1. An inertia switch device comprising:

an inertia body having a rest position and a disturbed position;

a casing forming a compartment for the inertia body and supporting the inertia body in the rest position thereof, a toggle operable by the inertia body, the toggle being movable from a first position to a second position in response to movement of the inertia body from the rest position to the disturbed position; and three contacts, the first of which is electronically connected only to the second when the toggle is in the first position thereof and only to the third when the toggle is in the second position thereof, and wherein, in an intermediate position of the toggle, the first contact is arranged to be electrically connected to both the second and third contacts.

2. A device as claimed in claim 1 wherein the electrical connection of the first contact with one of the second and third contacts is through the toggle.

3. An inertia switch device comprising:

an inertia body having a rest position and a disturbed position;

a casing forming a compartment for the inertia body and supporting the inertia body in the rest position thereof;

a toggle operable by the inertia body, the toggle being moveable from a first position to a second position in response to movement of the inertia body from the rest position to the disturbed position;

a member mounted in the casing operable for moving the toggle from the second to the first position, wherein said member is biased to a rest position in the casing which is independent of the toggle position; and wherein the toggle has arms inclined at an angle of inclination in the second position of the toggle, the member being formed with end surfaces for engaging the arms of the toggle, the end surfaces being inclined at an angle of inclination substantially the same as said angle of inclination of the toggle arms in the second position of the toggle.

4. A device as claimed in claim 3 wherein the member in the rest position of the member is spaced from the toggle in the first position of the toggle.

5. A device as claimed in claim 3 wherein one of the member and the casing is formed with a guide closed at one end, the rest position being defined by engagement of the other of the member and the casing with the closed end of the guide.

6. A device as claimed in claim 5 wherein the guide is formed in the casing, the member having a lug received in the guide.

7. A device as claimed in claim 3 wherein the end surfaces are laterally spaced and face each other.

8. A device as claimed in claim 3 wherein the member is formed with a resilient portion for engaging the casing to bias the member towards its rest position.

9. A device as claimed in claim 3 wherein said casing has a longitudinal axis, said casing being formed in one or more pieces, each of said pieces encircling said axis.

10. A device as claimed in claim 9 wherein the casing comprises a cup-shaped base piece and a cover piece for fitting to the base piece, the cover defining a path for a resetting member arranged to reset the toggle from the second to the first position.

11. A device as claimed in claim 3 wherein a flexible cap is mounted on the casing covering the member, the member being operable by pressure applied to the cap.

12. The combination of a fixing adaptor with an inertia switch device according to claim 3 wherein the casing of the inertia switch device is formed with sideways extending mounting lugs, positioned on sides of the casing, the lugs being formed with fixing holes, the adaptor being provided with a slot for receiving said lugs from above, the adaptor being formed with fixing holes which extend above the position of the lugs when received in said slot, the spacing of the closest parts of the adaptor fixing holes being less than the distance between the ends of the lugs, the arrangement being such that when fixing members extend through the adaptor holes, they lock the lugs in position in the adaptor slot.

13. The combination as claimed in claim 12 wherein the slot is defined by a front wall and a rear wall, the adaptor fixing holes extending through both of said from and rear walls, one of said walls having a division extending through the adaptor fixing hole defined therein.

14. The combination as claimed in claim 12 wherein the adaptor slot is formed with a latch for engaging a fixing hole of a casing lug.

* * * * *